US005795216A

United States Patent [19]

Graves

[11] Patent Number: 5,795,216

[45] Date of Patent: Aug. 18, 1998

[54] ABRADING TOOL HAVING A SUCTION SYSTEM FOR COLLECTING ABRADED PARTICLES

[75] Inventor: Philip Graves, Peoria, Ill.

[73] Assignee: DuMont Companies, Peoria, Ill.

[21] Appl. No.: 620,105

[22] Filed: Mar. 21, 1996

[51] Int. Cl.[6] ..... B24B 55/06

[52] U.S. Cl. ..... 451/456; 451/356; 451/360

[58] Field of Search ..... 451/456, 356, 451/358, 360, 363

[56] References Cited

U.S. PATENT DOCUMENTS 3,785,092 1/1974 Hutchins .
4,245,437 1/1981 Marton ..... 451/456
5,220,753 6/1993 Whitman ..... 451/456
5,239,783 8/1993 Matechuk ..... 451/456
5,297,363 3/1994 Schroder et al. ..... 451/456
5,545,080 8/1996 Clowers et al. ..... 451/456

*Primary Examiner*—Eileen Morgan
*Attorney, Agent, or Firm*—Anthony A. Davis

[57] ABSTRACT

An abrading tool adaptable to function as a needle scaler or chisel type device. Said abrading tool acts upon a surface to be treated in a efficient and environmentally safe manner, by removal of a work surface coating or fouling film, lead paint, rust, weld spatters, or the like, with low loss and collection of removed material dust and debris for safe filtering and disposal thereof so that operations such as boat hull and auto body cleaning or paint removal, for example, may be carried out without an inordinate hazard of contaminating the ambient work area environment.

12 Claims, 7 Drawing Sheets

ABRADING TOOL HAVING A SUCTION SYSTEM FOR COLLECTING ABRADED PARTICLES

ABRADING TOOLS. BACKGROUND OF THE INVENTION (1) Field of the Invention

The present invention relates to an abrading tool having suction for collecting abraded particles and more particularly to a abrading tool which: (a) may be easily adapted to function as a wire wheel, flap wheel sander, or grinding type device, (b) utilizes a remote power source via a flexible drive means as its motive force thereby lessening the weight of the hand-held workhead housing, (c) utilizes a remote vacuum means which operates in cooperation with said flexible drive means, and (d) incorporates a filtering system for removing contaminants from a stream of exhausted air.

(2) Description of the Prior Art

Abrading tools employing various features of the instant invention have been known in the art. With regard to the exemplary unit type of abrading tool which incorporates a suction system therein for the removal of abraded particles loosened from the work surface, typical teachings would be those as set forth in U.S. Pat. No. 3,785,092 to Hutchins dated Jan. 15, 1974 and U.S. Pat. No. 5,231,805 to Sander dated Aug. 3, 1993. The teachings of Schroder in U.S. Pat. No. 5,297,363 dated Mar. 29, 1993, also disclose a remote vacuum means. The Schroder patent has been assigned to the same entity who will own the property rights of the subject matter set forth herein for the instant invention.

It is also well known within the prior art of abrading devices to house an integrated power source therein such as an electrical motor. When using the aforementioned type of abrading tools, the operator is precluded from extended operation of the device at an elevated height greater than the operator's waistline due to the added weight of the integrated power source. The instant invention, by utilizing a remote power source, is comparatively lighter in weight thus permitting extended operation of the abrading tool at said elevated heights. Also, since the power source of the instant invention is housed at a remote location, the only electrical current transmitted to the abrading tool housing during the operation thereof is a low current (24 volts for example) for actuation of a push button or trigger switch located within the abrading tool housing to engage and disengage the remote power source. Said low current in the instant invention at the hand-held workhead housing is less in comparison to the electrical current which is necessary to effectively operate a conventional abrading tool with an integrated electrical power source (for example 110 volts). Due to the reduced voltage present at the hand-held workhead housing in the instant invention, the risk of electrocution to the operator during the use thereof is drastically reduced in wet or damp environmental conditions.

With regard to the exemplary use of a flexible drive means, Brook in U.S. Pat. No. 4,276,673 dated Jul. 7, 1981 shows a similar use being that of a flexible drive shaft upon a floor wax stripping apparatus. The teachings of Schroder also disclose a flexible drive means.

The flexible drive means as shown above in Schroder is similar to that of the instant invention; however, the flexible drive means in the instant invention is being utilized in a new and novel manner.

It is also well known in the prior art that abrading tools have been pneumatically powered. Pneumatically operated abrading tools are historically lighter in weight that those which incorporate an integrated electrical power source; however, a remote continuous supply of compressed air is required for operation of such abrading tools whereas the instant invention requires only a remote power conduit such as electricity to motivate the remote power source.

The applicants herein by their invention, however, provide a new and abrading tool having the advantage of being able to mechanically remove a surface coating with ease and efficiency substantially without dust and debris contamination therefrom of the ambient work area environment, and with a highly efficient means to withdraw and collect the removed dust and debris for safe handling and environmentally safe disposal thereof.

SUMMARY OF THE INVENTION

It is an object of the present invention to provide an improved lightweight abrading tool which employs a remote motive source as well as a remote vacuum means for removing a loosened work surface in an efficient and environmentally safe manner with low loss thus providing for the safe disposal of said dust and debris.

It is also an object of the present invention to provide a abrading tool adapted to be connectably assembled to a remote rotational drive power source for operation of said abrading tool, as well as also being concurrently connectably assembled to a remote vacuum means to thereby provide a pressure differential within the hand-held workhead housing for aspirated collection and transport of dust and debris as it is removed from a work surface on out through the abrading tool discharge port and by way of an interconnected vacuum conduit to containment within the vacuum system collection means, whereby substantially all abradingly removed work surface dust and debris is captured and contained for disposal with low loss thereof to contaminate the ambient work area environment.

An additional object of the present invention is to provide a lightweight abrading tool housing thus permitting extended use by the operator thereof for an extended period of time in comparison to like abrading tools which incorporate an integrated power source.

Yet another object of the present invention is to provide a abrading tool which embodies the use of a low voltage power source conduit and a flexible drive shaft in connection with the remote power source (rotary motion) drive to the hand-held workhead housing, where the flexible drive shaft and low voltage conduit are snaked through the hand-held workhead housing and interconnected vacuum conduit to thereby contain all abrading tool housing connectors within a single line for enhanced operator ease and efficiency during use.

It is also an object of the present invention to provide an abrading tool whereby operational torque vibration set up in the flexible drive shaft housed within the interconnected vacuum conduit effects a vibratory means whereby the vacuum conduit is continually shaken and accumulation of dust and debris therewithin and clogging thereof is thereby prevented.

An additional object of the present invention is to provide a abrading tool wherein the work surface removed dust and debris are separated from the aspirating air stream by means of a collection bag, a conventional air filter, and a high efficiency particulate attenuation filter before being exhausted into the environment.

Still another object of the present invention is to provide a abrading tool with a hand-held workhead housing adapted to protectively cover and enclose the operable work surface area in a substantially air tight manner.

It is also an object of the present invention to provide a abrading tool which is mechanically simple and economical to make and operate.

The foregoing, and other objects, hereof, will be readily evident upon a study of the following specification and the accompanying drawings comprising a part thereof.

DETAILED DESCRIPTION OF THE INVENTION

Figure 1:
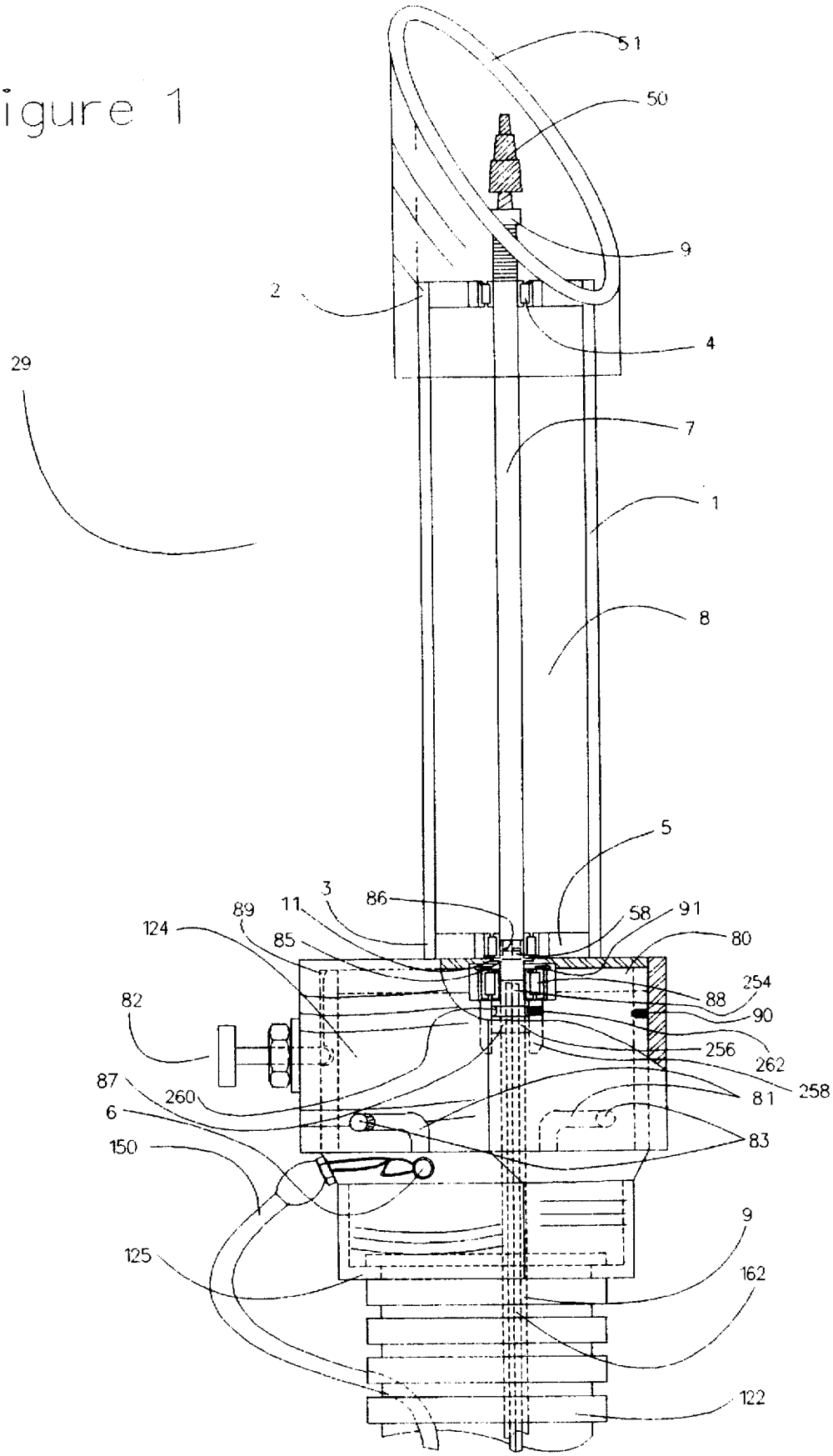
FIG. 1 is a side view of an abrading tool with the flat underside portion rotated toward the viewer.
Figure 4:
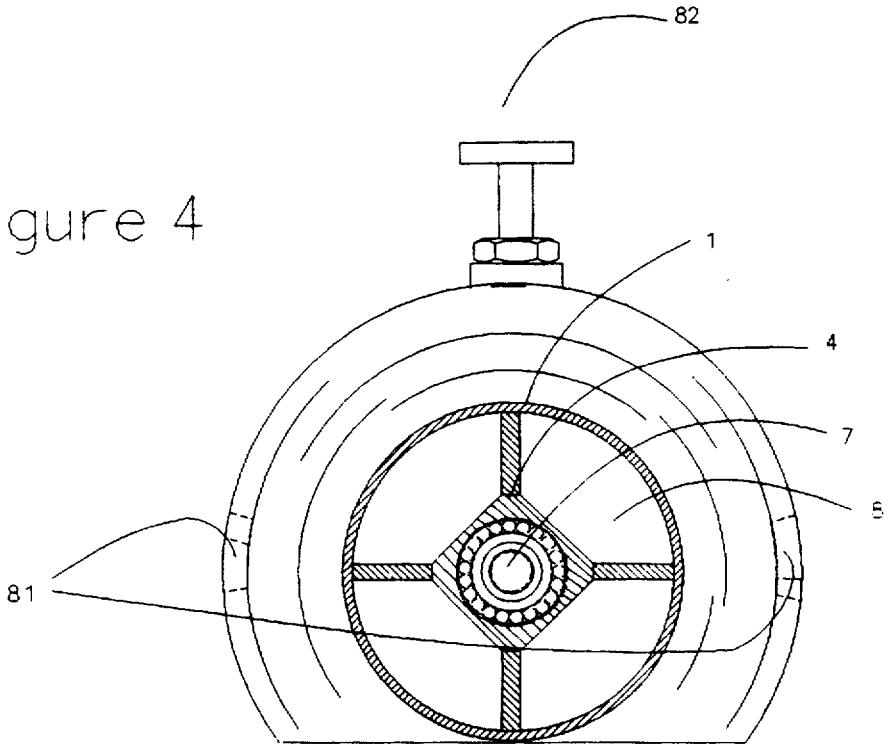
FIG. 4 is a top view of an abrading tool; showing the top bearing plate and arbor to which abrading devices may be attached.

Referring to FIG. 1, an abrading tool is illustrated and includes a tubular housing 1. The inner periphery of said tubular housing 1 is hereby defined as an exhaust chamber 8 which is further defined by a front portion 2 and a rear portion 3. An arbor 7 is pressed fitted into a second bearing plate 5 (also illustrated in FIG. 4) until the arbor flange 11 becomes nominally engaged with said second bearing plate 5. The second bearing plate 5, which now carries the press fitted arbor 7, is then press fitted into the rear portion 3 of said tubular housing 1. The arbor, now extending the entire length of the exhaust chamber 8, is then received and journaled within a first bearing plate 4 as the first bearing plate 4 is press fitted into the front portion 2 of the tubular housing 1 (also illustrated in FIG. 4). The end of the arbor 7 terminating at the rear portion 3 is defined by a mandrel drive slot 58. The end of the arbor 7 terminating at the front portion 2 is equipped to threadably engage an tapered nut 9.

The rear portion 3 of the exhaust chamber 8 is fluidly attached to a discharge port 124. The discharge port 124 and said tubular housing 1 together generally define the hand-held workhead housing 29. The lower end of the discharge port 124 also contains two opposed elongated slots 81 and a spring loaded set pin 82. Said discharge port 124 is cooperatively conformed to slidably receive in close tolerance a bearing mounting plate 80 as fully described below.

Figure 3:
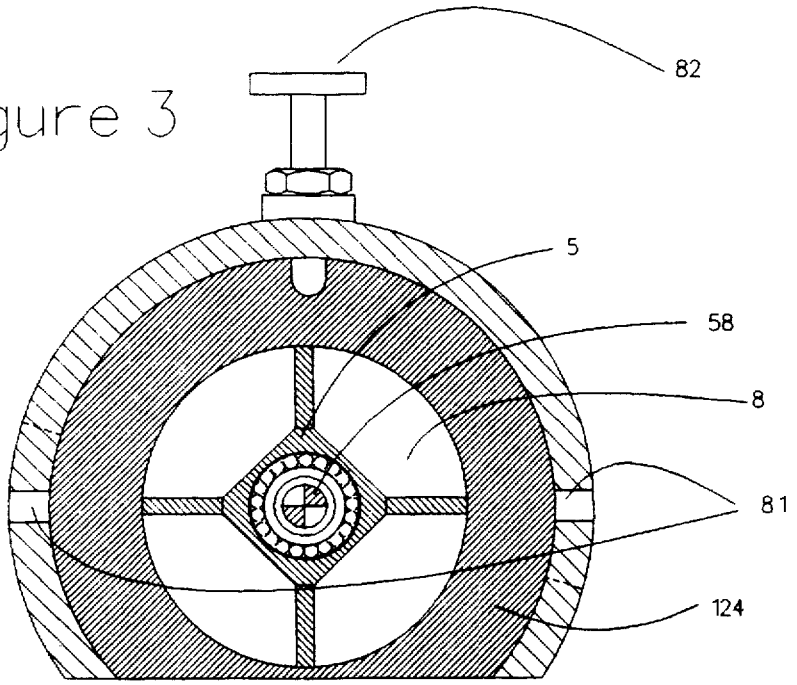
FIG. 3 is a bottom view of an abrading tool; showing the connective portion of the apparatus which will receive and secure the remote vacuum source and remote power source.
Figure 6:
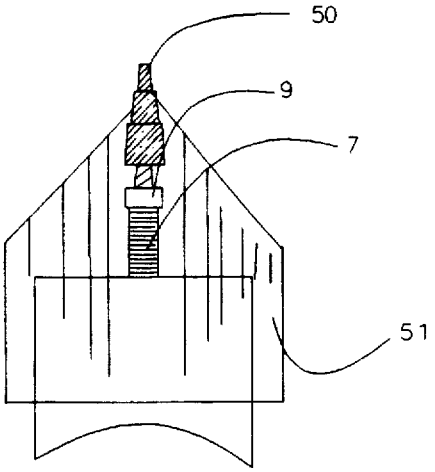
FIG. 6 is a top view of an abrading tool with a angular dust shroud attached thereto which is shaped in a manner to allow the operational use employment of the abrading tool.
Figure 8:
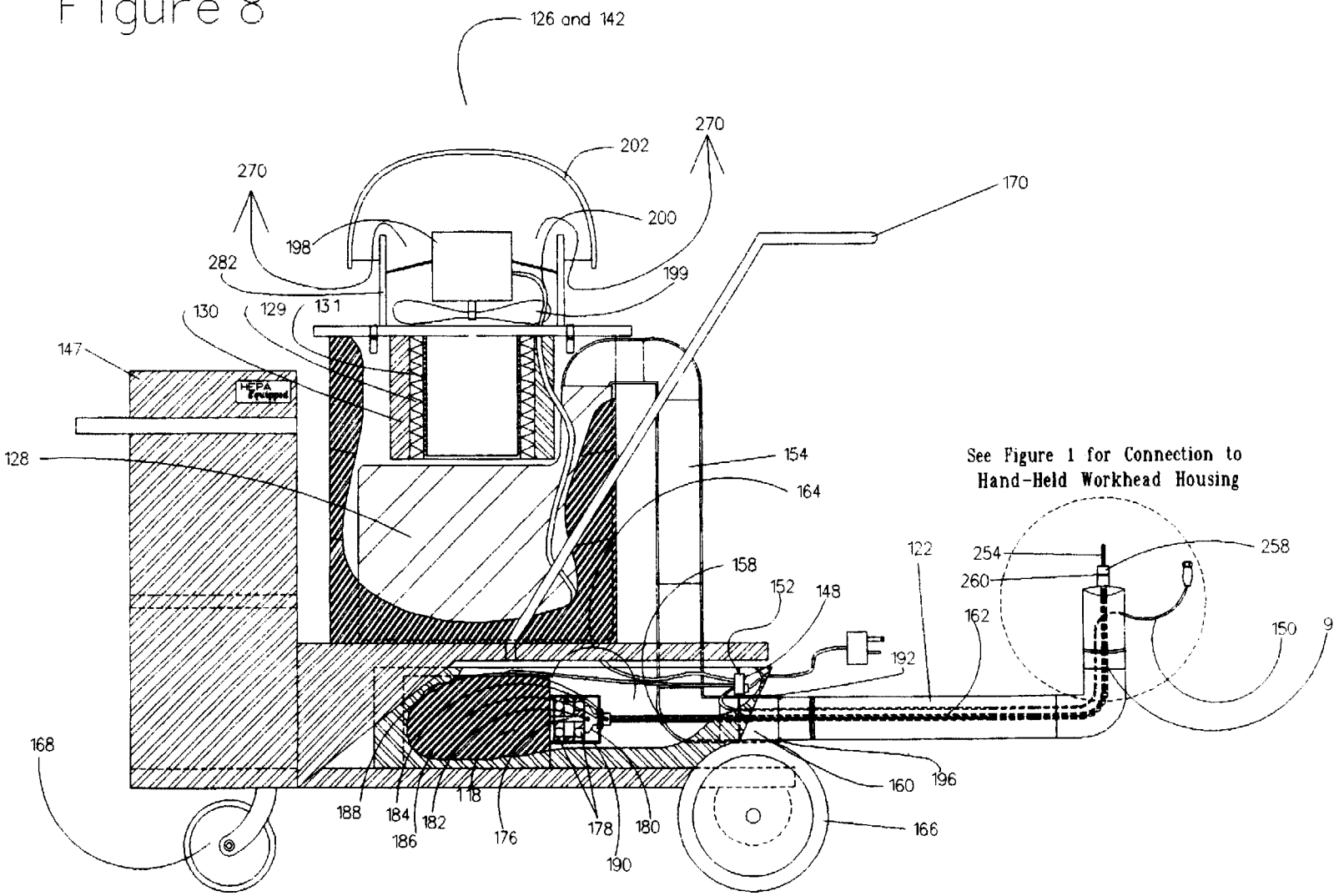
FIG. 8 is a view partly in section, of the remote power source, the remote vacuum source, the mobile hand cart, and the connecting apparatus which joins the hand-held workhead housing depicted in FIG. 1 to the remote vacuum source and the remote power source.

A resilient shroud member 51 is sized to slidably receive in close tolerance the outer periphery of the front portion 2 of the tubular housing 1. FIG. 6 shows another preferred embodiment of the resilient shroud member 51 being shaped in a manner which allows an operator of the hand-held workhead housing 29 to effectively abrade a corner area of a work surface being prepared, while maintaining a satisfactory pressure differential within the resilient shroud member 51. Said exhaust chamber 8 fluidly connects with the resilient shroud member 51 thereby allowing the dust and debris removed from a work surface being prepared by the operation of the abrading tool to travel through the exhaust chamber 8 are drawn into the front portion 2 past the first bearing mounting plate 4 (also shown in FIG. 4), then through the second bearing mounting plate 5 (also shown in FIG. 3) through the discharge port 124 to the vacuum conduit 122 whereby the dust and debris suspended in the exhausted air are deposited into the vacuum source collection bag 128 and then filtered before being expelled into the environment (as illustrated in FIG. 8). The evacuation of the dust and debris is accomplished by a pressure differential created by an industrial vacuum cleaner 142 with said pressure differential being transferred from the industrial vacuum cleaner 142 to the vacuum conduit 122, to the discharge port 124, to the exhaust chamber 8, to the resilient shroud member 51.

It will be noted that the remote power source 118 and the remote vacuum source 126 are separate from the hand-held workhead housing 29, thereby enabling a lighter and more compact unit. Another functional advantage of having the remote power source 118 and remote vacuum source 126 remote from the hand-held workhead housing 29 is that, again because of a lighter and more compact workhead housing unit, one is thereby also enabled to operate in more restricted work areas than would otherwise be possible.

Figure 2:
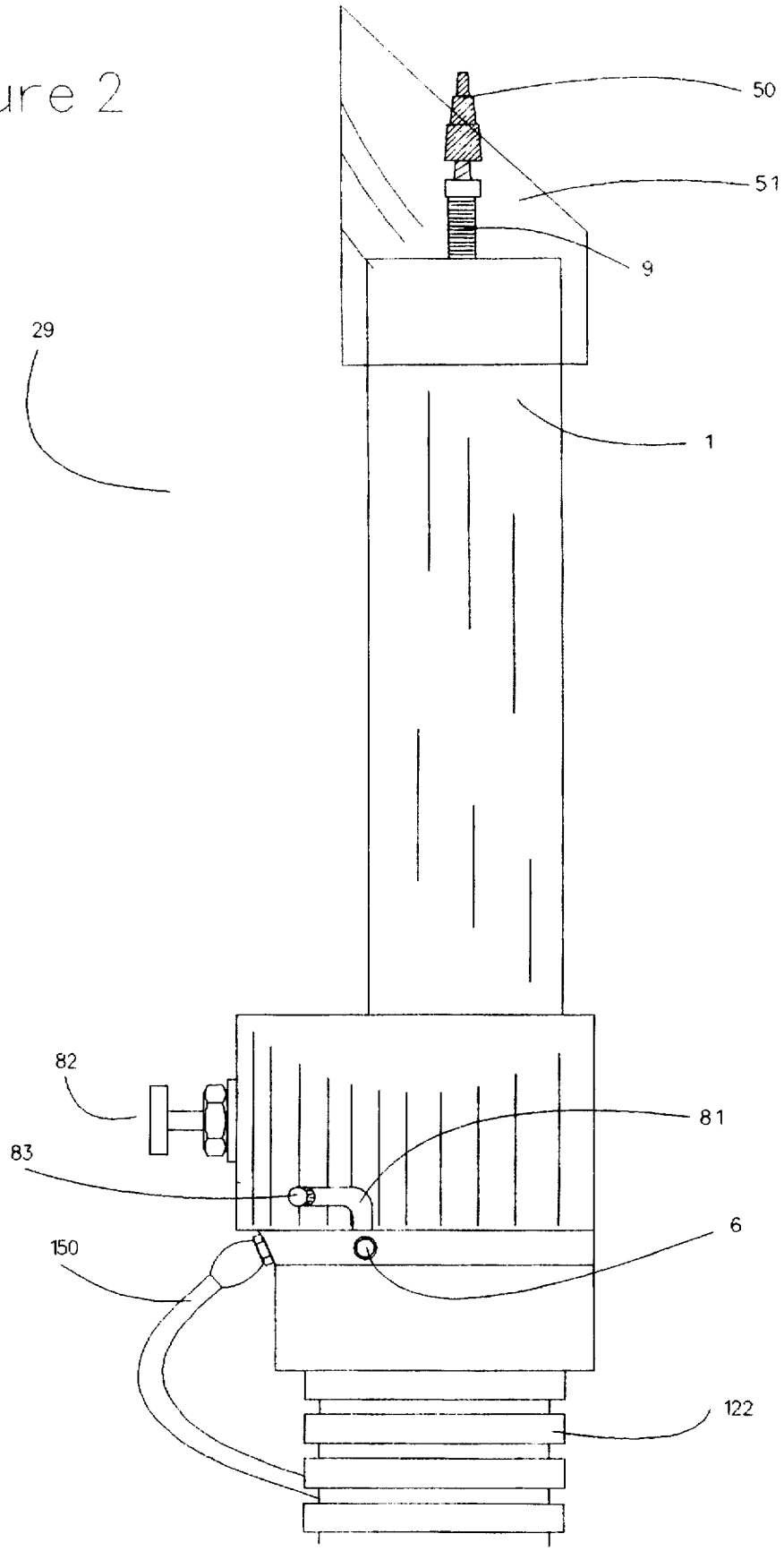
FIG. 2 is a side view of an abrading tool.

The preferred embodiment of the abrading tool as illustrated in FIGS. 1 and 2 show the hand-hand workhead housing 29 which is sized to integrally receive the bearing mounting plate 80 which contains the flexible drive shaft 9, the power transfer conduit 150, and the vacuum conduit 122 which are assembled to a remote power source 118 and an industrial vacuum cleaner 142 (shown in FIG. 8). The respective motors of the remote vacuum source 126 and the flexible drive shaft 9 remote power source 118 operate off a push button or trigger 6 switch to control the electrical current fed through a power transfer conduit 150 from the electrical control box 152. The electrical control box 152 incorporates an on/off switch 148 which regulates all electrical current running to the push button or trigger 6 located in the hand-held workhead housing 29.

Now referring to FIG. 8, the industrial vacuum cleaner 142 has been adapted by means of an auxiliary vacuum conduit 154 which directs the vacuum air flow from the vacuum conduit 122 through the auxiliary vacuum conduit intake 160 into the collection bag 128. The rubber grommet 158 also provides a sealing means whereby the flexible drive shaft 9 and flexible drive shaft housing 162 are admitted from the vacuum conduit 122 for connection by motor coupling 164 to the remote power source 118.

A mobile hand cart 147 with a handle 170, a set of pneumatic tires 166, and a set of casters 168 is utilized to transport the remote vacuum source 126 and the remote power source 118.

An additional aspect of the abrading tool operation that is best illustrated in FIGS. 1 and 2 than elsewhere is that as an operator applies the abrading tool of the hand-held workhead housing 29 to the surface to be worked, and an increased torque load is thereby placed upon the remote power source 118, the flexible drive shaft 9 tends to vibrate and shake the vacuum conduit 122 sufficiently so that any tendency of the removed dust and debris to collect within and clog up the vacuum conduit 122 interior passageway is prevented by the aforedescribed flexible drive shaft 9 vibratory torque load phenomenon.

The hand-held workhead housing 29 and sub-assembly component parts thereof such as the tubular housing 1 and discharge port 124 and sub-components, as well as other parts shown and illustrated in FIGS. 1–6 and certain subsequent Figures hereinafter, may be fabricated by accepted manufacturing methods and techniques from various metals and alloys thereof, or plastics, or combinations of metals, metal alloys, and plastics.

Referring now again to the enlarged cut-away side elevation view of the remote power source as shown in FIG. 8, to better describe the connection of the hand held workhead housing 29 thereto, and considering first connection of the flexible drive shaft 9 to the remote power source 118 by means of the motor coupling 164. It will be noted that the power source drive shaft 176, being journaled within a set of spaced bearings 178, has a flexible drive shaft power source connector 180 assembled thereto by means of a power source drive shaft connector set screw 182. A forward projecting recessed nose 184 of the flexible drive shaft power source connector 180 is configured as a female fitting to insertably receive in a close complementary slidable communication therewithin the forward projecting square male fitting extension 186 of the flexible drive shaft 9, all being held together by means of the flexible drive shaft coupling collar 188 threadable connection within the power source drive shaft journal housing 190. Thus, by means of the motor coupling 164, when the remote power source 118 is activated by the push button or trigger 6, released to the "out" position, the power source drive shaft 176 rotary motion is thereby transmitted to the flexible drive shaft 9 which in turn, rotating within the flexible drive shaft housing 162. The means of coupling the vacuum conduit 122 to the auxiliary vacuum conduit intake 160 is by twistably engaging the leading conduit rib 192 of said vacuum conduit 122 within the auxiliary conduit intake fitting flange 196, whereupon the two are joined. Still referring to FIG. 2, the filtering mechanism for removing air borne contaminants from the exhausted air stream 270 is described as follows: as a result of the pressure differential created by the vacuum source motor 198 and vacuum source fan 199, the exhausted air stream 270 enters the vacuum source collection bag 128 which removes larger (such as paint chips) foreign contaminants, the exhausted air stream 270 then fluidly passes through a conventional cylindrical air filter 130 and then through a cylindrical high efficiency particulate attenuation filter 129 which together remove a high percentage amount of the remaining air-borne contaminants from the exhausted air stream 270. The conventional cylindrical air filter 130 and the cylindrical high efficiency particulate attenuation filter 129 are held in place by a cylindrical mesh plenum 131. The exhausted air stream 270 then passes fluidly around the vacuum source motor 198 and vacuum source fan 199 to the chamber defined by the vacuum cleaner top 202, which is fixedly attached to the vacuum motor source housing 282 at sleeted points, before being expelled into the environment.

It will also be noted that the vacuum source electric motor 198 is provided with a slack power cable 200, thereby enabling extension thereof during removal of the vacuum cleaner top 202 with the attached vacuum source electric motor 198 for purposes of removing and replacing the filled vacuum source collection bag 128, the conventional cylindrical air filter 130, or the cylindrical high efficiency particulate attenuation filter 129.

Figure 7:
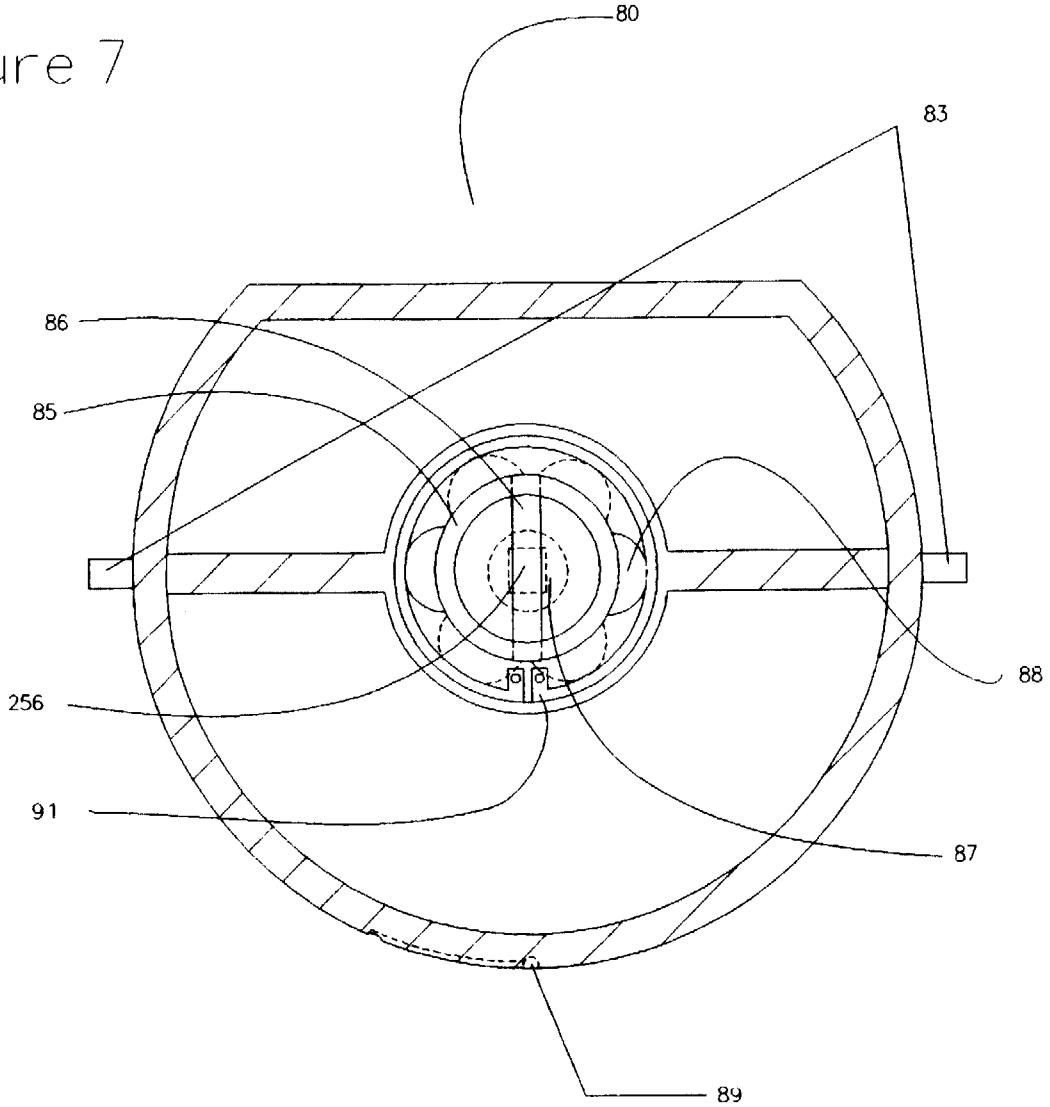
FIG. 7 is a top view of the bearing mounting plate from the end which is inserted into the discharge port of the hand-held workhead housing whereby the two are joined.

Referring now to FIGS. 1, 2 and 7, the third bearing mounting plate 80 is sized on its terminal end to allow its close tolerance slidable insertion into the discharge port 124. The outer periphery of the third bearing mounting plate 80 contains two opposed set pins 83. The intermediate portion of the third bearing mounting plate 80 incorporates therein a push button or trigger 6 for the engagement and disengagement of said remote power source 118 and said remote vacuum source 126. The intermediate portion of said bearing mounting plate 80 incorporates therein a threaded connection for engaging a power transfer conduit 150. The electrical current resident within the power transfer conduit 150 is conducted to a push button or trigger 6 which is also positioned within the intermediate portion of the third bearing mounting plate 80. When depressed, the push button or trigger 6 disengages the remote power source 118 and the remote vacuum source 126 thereby acting as a "kill switch" for the abrading tool. The other end of the third bearing mounting plate 80 is sized to slidably receive the vacuum conduit 122. The third bearing mounting plate 80 and the vacuum conduit 122 are joined by twistably engaging one end of the conduit ribs of said vacuum conduit 122 within the mounting plate flange 125, whereupon the two are joined. The terminal end of the third bearing mounting plate 80 consists of a drive key 85 comprised of a drive key collar having a drive key roll pin 86 mounted therein which insertably engages the mandrel drive slot 58 when the drive key shaft 87 rotationally rides within a spaced set of discharge port spider bearings 88. The drive key shaft 87 is engaged by the flexible drive shaft 9 by close complementary slidable insertion of the drive end square male drive shaft fitting extension 254 into the cooperatively conformed drive key shaft recess 256 whereby rotary motion imparted by the flexible drive shaft 9 (via the remote power source 118) to the drive key 85 (from the drive key shaft 87) to the hand-held workhead housing 29. In order to secure the drive fitting assembly of the drive end square male drive shaft fitting extension 254 within the drive key shaft recess 256 in such a way as to be sufficiently flexible so that motion and movement of the hand-held workhead housing 29 may be accommodated in use operation, without binding of the drive transmission means herein described, the workhead drive shaft union is retained in place by means of a flexible drive shaft affixed cylinder collar 258 provided with a circumferential groove 260 therein which groove is nominally engaged retainably by a complementary bullet nosed set screw 262 secured in threadable extension perpendicularly through the third bearing mounting plate 80 in such a manner as to allow relative axial rotation of said third bearing mounting plate 80 and said crank housing 1 with respect to said workhead drive shaft union. The third bearing mounting plate 80 contains a set screw aperture 90 through which a hand tool may be inserted to effectively engage and disengage said bullet nosed set screw 262 in relation to the circumferential groove 260 on the cylinder collar 258. It will be further noted that the drive key shaft 87 is rearwardly retained in place by snap ring 91 (shown in FIG. 7).

Rotary motion is imparted to the arbor 7 by the drive key 85 when the bearing mounting plate 80 is connectably engaged into the discharge port 124. Said engagement is accomplished when the two opposed set pins 83 are insertably engaged into the two opposed elongated slots 81 in a twisting motion until the set pin recess 89 becomes engaged by the spring loaded set pin 82 thereby securing the third bearing mounting plate 80 to the discharge port 124. The spring loaded set pin 82 must be pulled in an outward direction in relation to the third bearing mounting plate 80 to effect the disengagement of the spring loaded set pin 82 from the set pin recess 89 thereby allowing the reverse twisting motion of the crank housing 1 in third relationship to the bearing mounting plate 80 until the two opposed set pins 83 are disengaged from the two opposed elongated slots thus effectively disconnecting of the third bearing mounting plate 80 from the discharge port 124.

Figure 5:
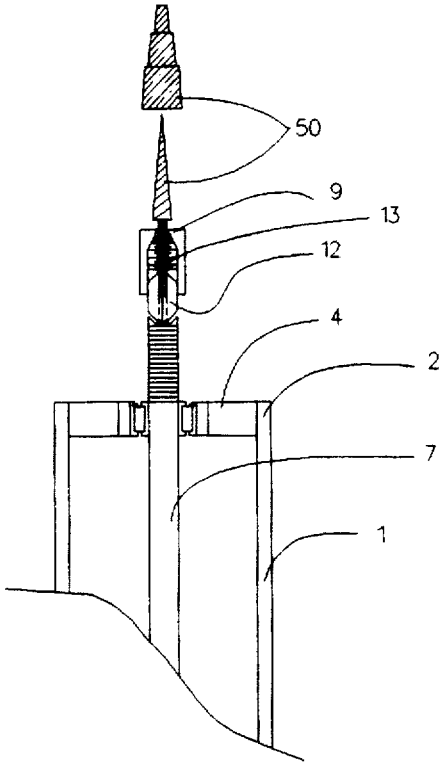
FIG. 5 is an exploded view of the arbor and an exemplary abrading device to be attached thereto.
Figure 9:
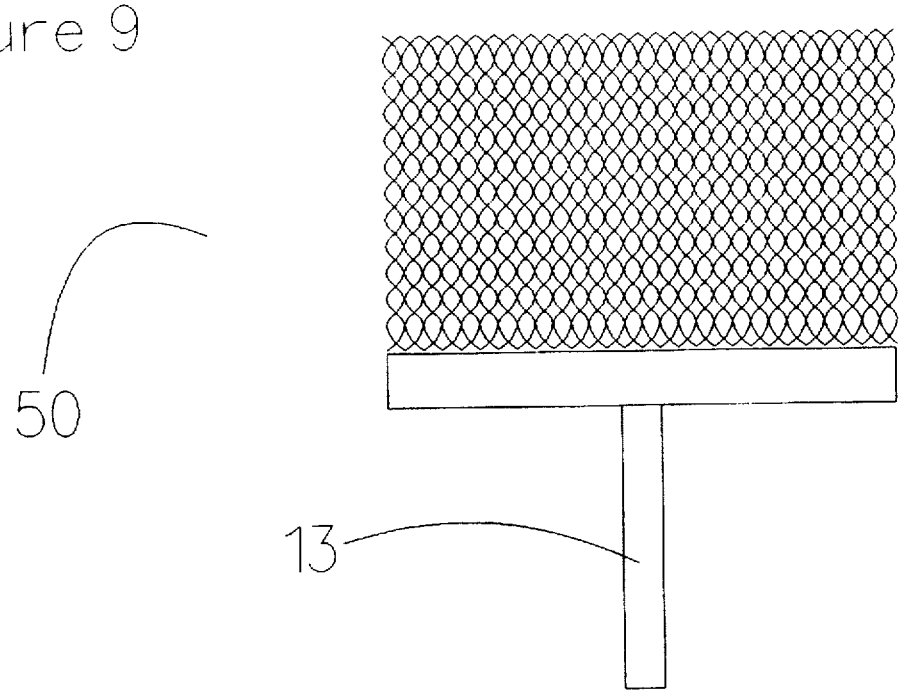
FIG. 9 is a side view of a conventional wire wheel abrading tool.
Figure 10:
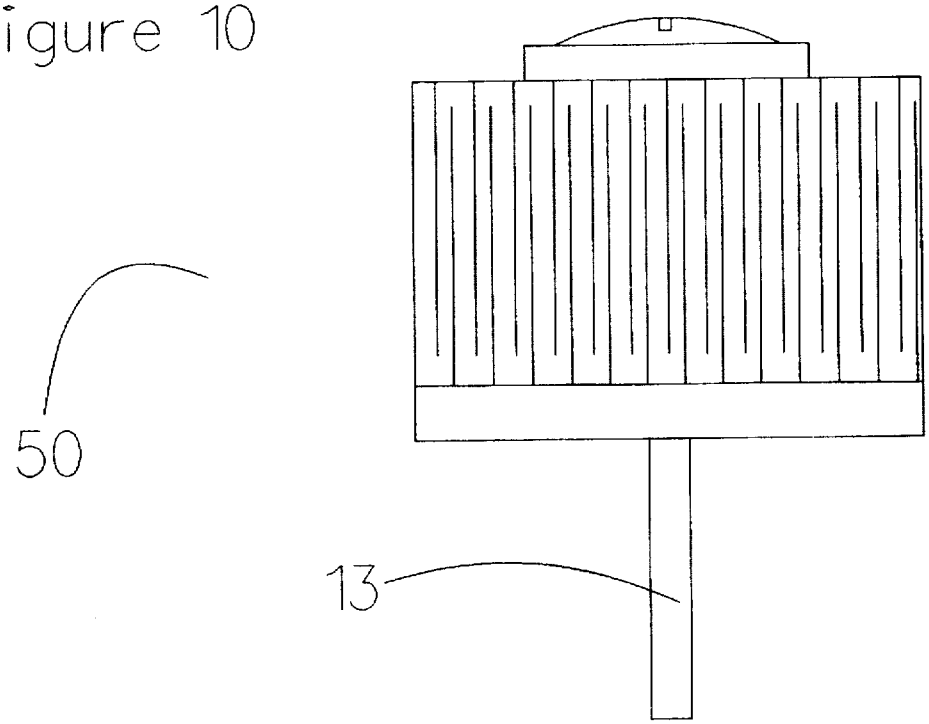
FIG. 10 is a side view of a conventional flap wheel abrading tool.

Now referring to FIG. 5, a convention abrading tool 50 is secured to the arbor 7 by a tapered nut 9 which exerts progressive frictional pressure upon a convention abrading tool shaft 13, via a squeezable collet 12, as the tapered nut 9 is engaged upon the threaded portion of the arbor 7. To remove and replace a convention abrading tool 50 now secured within the arbor 7 with a different conventional abrading tool 50 (for example: a wire wheel as shown in FIG. 9, or a flap wheel as shown in FIG. 10), the resilient shroud member 51 must be removed by grasping said resilient shroud member and simply exerting pressure in a direction opposite from said front portion of the tubular housing 1 until the resilient shroud member 51 becomes slidably separated therefrom. The tapered nut 9 must be loosened (but removal thereof is unnecessary) from threadable engagement with said arbor 7 by twisting said tapered nut 9 in a counter clockwise direction, in relation to said arbor 7, until the threads of the two pieces become disengaged to an extent where the frictional pressure exerted upon the convention abrading tool shaft 13, via the squeezable collet 12, is lessened to an extent whereupon the conventional abrading tool 50 may be slidably removed from the arbor 7. The installation of a conventional abrading tool 50 is accomplished by reversing the order of the steps set forth above for removing a conventional abrading tool 50.

Although the abrading tool invention hereof, the structural and functional characteristics and methods of employment thereof, respectively have been shown and described in what is conceived to be the most practical and preferred embodiment, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

We claim:

1. An abrading tool adaptable to clean surface portions of contaminants on structures in difficult to reach places, while permitting enclosure of such contaminants away from the environment, comprising:

a tubular housing;

said tubular housing is further defined as having an inner and outer periphery;

said inner periphery is further defined as having a front and rear portion;

said front portion contains a first bearing plate demountably secured therein;

said rear portion contains a second bearing plate demountably secured therein;

an arbor is demountably journaled within and extends through said first bearing plate and said second bearing plate thereby terminating in close proximity of said front and rear portions; the end of the arbor terminating in close proximity with the rear portion contains a drive means;

the end of the arbor terminating in close proximity with the front portion contains a tool attachment means;

said tubular housing is fluidly connected to an integral discharge port;

said discharge port contains a button switch to actuate a remote empowerment means;

a power supply enclosed within a power transfer conduit in communication with said button and said remote empowerment means;

said remote empowerment means being engaged by the button through said power transfer conduit;

a vacuum conduit fluidly interconnecting said discharge port to a remote vacuum means;

a flexible drive shaft interconnecting said remote empowerment means with said drive means, thereby being snaked through said vacuum conduit from the interconnection thereof with the discharge port at one end of said vacuum conduit to the interconnection thereof with said remote vacuum means at the other end of said vacuum conduit whereby operational torque vibration set up in said flexible drive shaft enclosably housed within said vacuum conduit in turn imparts a vibratory shaking thereto;

said power transfer conduit interconnecting said button to said remote empowerment means being snaked through said vacuum conduit from interconnection thereof with the button at one end of said vacuum conduit to the interconnection thereof with said remote empowerment means at the other end.

2. An abrading tool according to claim 1 wherein said drive means is a mandrel slot.

3. An abrading tool according to claim 1 wherein said remote empowerment means is an electric motor.

4. An abrading tool according to claim 1 wherein said remote vacuum means is an industrial vacuum cleaner.

5. An abrading tool according to claim 4 wherein said industrial vacuum cleaner is adapted to accommodate one or more collection bags.

6. An abrading tool according to claim 4 wherein said industrial vacuum cleaner is adapted to accommodate one or more high efficiency particulate attenuation filters.

7. An abrading tool according to claim 1 wherein said remote vacuum means is a high capacity vacuum cleaner.

8. An abrading tool according to claim 7 wherein said remote empowerment means is an electric motor.

9. An abrading tool according to claim 8 wherein said electric motor is separate from said industrial vacuum cleaner.

10. An abrading tool according to claim 9 wherein said electric motor with a flexible drive shaft motor coupling interconnecting said flexible drive shaft to said electric motor is protectively housed within a carrying enclosure.

11. An abrading tool according to claim 1 wherein the outer periphery of the front portion is sized to accept in close tolerance a resilient shroud member.

12. An abrading tool according to claim 1 wherein said tool attachment means is a threaded portion to engage a tapered nut.

* * * * *